US005800016A

United States Patent [19]

Allred

[11] Patent Number: 5,800,016

[45] Date of Patent: Sep. 1, 1998

[54] ELEVATING CHAIR

[76] Inventor: Lyle Allred, 848 S. 3rd St., Othello, Wash. 99344

[21] Appl. No.: 813,453

[22] Filed: Mar. 10, 1997

[51] Int. Cl.[6] ..... A47C 3/20

[52] U.S. Cl. ..... 297/344.17; 248/421; 297/344.15

[58] Field of Search ..... 297/344.15, 344.17; 248/421

[56] References Cited

U.S. PATENT DOCUMENTS

| | | | |
|---|---|---|---|
| 2,233,262 | 2/1941 | Jacobson | 297/344.15 X |
| 3,596,982 | 8/1971 | Grams | 297/71 |
| 4,083,599 | 4/1978 | Gaffney | 297/131 |
| 4,477,117 | 10/1984 | Higgs | 297/45 |
| 4,744,712 | 5/1988 | Mitchell | 248/421 X |
| 5,060,960 | 10/1991 | Branscumb et al. | 280/250.1 |
| 5,094,508 | 3/1992 | Bathrick et al. | 297/320 |
| 5,161,812 | 11/1992 | DeWeese | 280/47.38 |
| 5,285,992 | 2/1994 | Brown | 248/421 |
| 5,402,544 | 4/1995 | Crawford et al. | 297/344.17 X |
| 5,423,562 | 6/1995 | Pearce, Jr. | 280/250.1 |

FOREIGN PATENT DOCUMENTS

| | | | |
|---|---|---|---|
| 94021154 | 9/1994 | European Pat. Off. | 297/344.15 |
| 358199231 | 11/1983 | Japan | 297/344.15 |
| 404354905 | 12/1992 | Japan | 297/344.17 |

*Primary Examiner*—Peter R. Brown

[57] ABSTRACT

The disclosed invention is a means of providing an individual with increased ambulatory function through the use of a wheeled chair. The chair includes a lift mechanism, which is comprised of a linkage and an actuation means that can be operated by the user without assistance from another individual. The combination enables a user of compromised physical capabilities, to locomote from one place to another and perform daily tasks that would require bending or reaching. The chair is lightweight and very mobile, thereby minimizing restrictions to the user. The lift mechanism linkage and actuation means minimizes torque on the motor of the actuation means, eliminating current draw spikes which would stall the motor when the battery is low. The lightweight and low friction linkage design maximizes the function of the invention by keeping the battery and actuation means small, thereby reducing the weight and increasing the mobility of the chair.

6 Claims, 8 Drawing Sheets

ELEVATING CHAIR

BACKGROUND OF THE INVENTION

1. Field of the Invention

The invention herein relates to improvements in and relating to wheeled chairs for the non-ambulatory or those with limited ambulatory function, and more specifically to wheeled chairs that are capable of vertical movement, thereby adding to the functionality of the user in day to day activities which involve interaction with objects of various heights.

2. Overview of Prior Art

A variety of art exists in the area of wheeled chairs but the art is filled with devices that have truly limited functionality. For a person in a wheel chair, stooping down to pick up a fallen object or to retrieve something off of a shelf or cabinet is difficult if not impossible without getting out of the chair. For many this is not an option. As a result chairs that involve vertical movement have been developed, but with only limited success. Higgs, in U.S. Pat. No. 4,477,117, disclosed such a chair. Here a folding wheel chair is disclosed with a pair of vertically slidably mounted guides and an elevation means to vertically displace the seat and back rest on a supporting frame. While such a device might seem plausible, the excessive manufacturing expense of the low friction linear movement mechanism that can be feasibly driven by a motor and screw mechanism is simply not practical. The energy loss to friction would dictate a heavier, more powerful motor and if the device is to be powered by a battery, the limited life or extra weight of additional batteries make the product undesirable.

Linear movement is also used in the telescoping back frame of U.S. Pat. No. 5,094,508 as disclosed by Bathrick et al. Here the function of the device is only to assist the user in getting out of the chair by raising the rear of the seat and pivoting the front. The device is not fitted with wheels of any kind and the device is disclosed with a cord to provide power to the motor. This cord necessitates the chair be virtually immobile even if wheels were fitted onto the frame. As such, the torsion of the actuator and the eccentric load placed on the telescoping members would indicate high friction losses and limit the efficiency of the system.

Mechanical methods of vertical displacement are also disclosed. The first, by Pearce, Jr. in U.S. Pat. No. 5,423,562 uses a mechanical crank to elevate a chair which, again is slidably mounted onto the frame. The lack of physical strength of an injured or aged population, the majority of which would be using such a device, would preclude them from using such a device, therefore another person must adjust it for them. In addition the device must be entered from the rear or by stepping over the sides of the chair, making entry difficult if not impossible for those with ambulatory restrictions.

The second such mechanically adjusted device was disclosed by Branscumb et al. in U.S. Pat. No. 5,060,960 in which a hydraulic jack is used to vertically displace a slidably mounted seat on a wheeled chair. As before, a second person is required to actuate the device, which here is understandable in that the device is intended to facilitate the transfer of the user to and from a bed. Many times these users have very limited physical abilities and therefore require assistance. This necessitates another person be present to assure safety in making the transfer. This device is primarily intended to assist the attending person, not the user seated in the chair.

Gaffney in U.S. Pat. No. 4,083,599 disclosed an overstuffed rocking chair that could be fitted with wheels that includes a linkage mechanism and a actuator to vertically displace and tilt the chair to facilitate entry and exit from the chair. Not only is the chair intended to assist in exiting the chair and not functional use at different heights, but the physical size of the chair makes it very limited in mobility. In addition, the wheels are disclosed as being fit onto the frame, separate from the lift mechanism, thereby disengaging the wheels from the ground when the lift mechanism has been actuated. This obviously precludes translation of the device and user at any height other than at the fully retracted position making the device nonfunctional as a variable height wheeled chair.

A wheeled commode is disclosed by DeWeese in U.S. Pat. No. 5,161,812. Here as with Branscumb et al. the device is lifted by a hand powered hydraulic rain for the purpose of assisting in patient transfer. A linkage mechanism is used to vertically displace the seat but four slidably mounted tubes are used to guide the movement. The linkage design is not desirable in this case because the load applied to the ram, and therefore the user physically actuating the ram, is great at the bottom position of the seat and gradually decreases as the seat moves upward. Also fluid power systems such as these disclosed have a tendency to leak over time. This is not only messy but potentially dangerous, having spilled oil on the floor of a hospital or any other environment with people of limited physical capability.

A seat with a linkage provided to lift the seat was disclosed in U.S. Pat. No. 3,596,982 to Grams. This is a patent chair such as would be used by a patient of a dentist. Mobility of the chair is not disclosed nor desirable in that the chair is intended to manipulate the patient into various positions to better enable the practitioner to perform his duties. The device is to heavy and cumbersome to be used in any manner of locomotion even if wheels were affixed thereto.

SUMMARY OF THE INVENTION

The object of the disclosed invention is to provide a means of ambulatory function of an individual through the use of a wheeled chair. The chair includes a lift mechanism which is comprised of a linkage and an actuation means that can be operated by the user without assistance from another party. The combination enables a user with physical limitations to locomote from one place to another and perform day to day tasks that would typically require bending or reaching. The chair is lightweight and very mobile, thereby minimizing restrictions to the user. The lift mechanism linkage and actuation means, including a spring for counterbalance, are designed to equalize the load placed on the motor or other power source, eliminating current spikes which would stall the motor when power decreased, as would happen when a battery used to drive the actuation means began to run low. The lightweight and low friction linkage design maximizes the function of the invention by keeping the battery and actuation means small, thereby reducing the weight and increasing the mobility of the chair.

DETAILED DESCRIPTION OF THE PREFERRED EMBODIMENT

As the life expectancy of our population rises, certain difficulties emerge as being more widespread to our society. Problems associated with the care and functional independence are paramount to the health and well being of that ever growing segment of our population. Many of those problems are directly associated with ambulatory function. Being able to move about in order to accomplish daily tasks is something that most take for granted but for the physically challenged the problem is paramount. Common wheeled chairs are functional only in the sense that someone can move from point "A" to point "B" but this is of little consequence if that wheeled chair limits the user from performing the intended task upon arrival at the destination. Wheeled chairs offer movement in what is referred to as the "x" and "y" directions, but most offer no ability for movement in the "z" or vertical direction.

Figure 1:
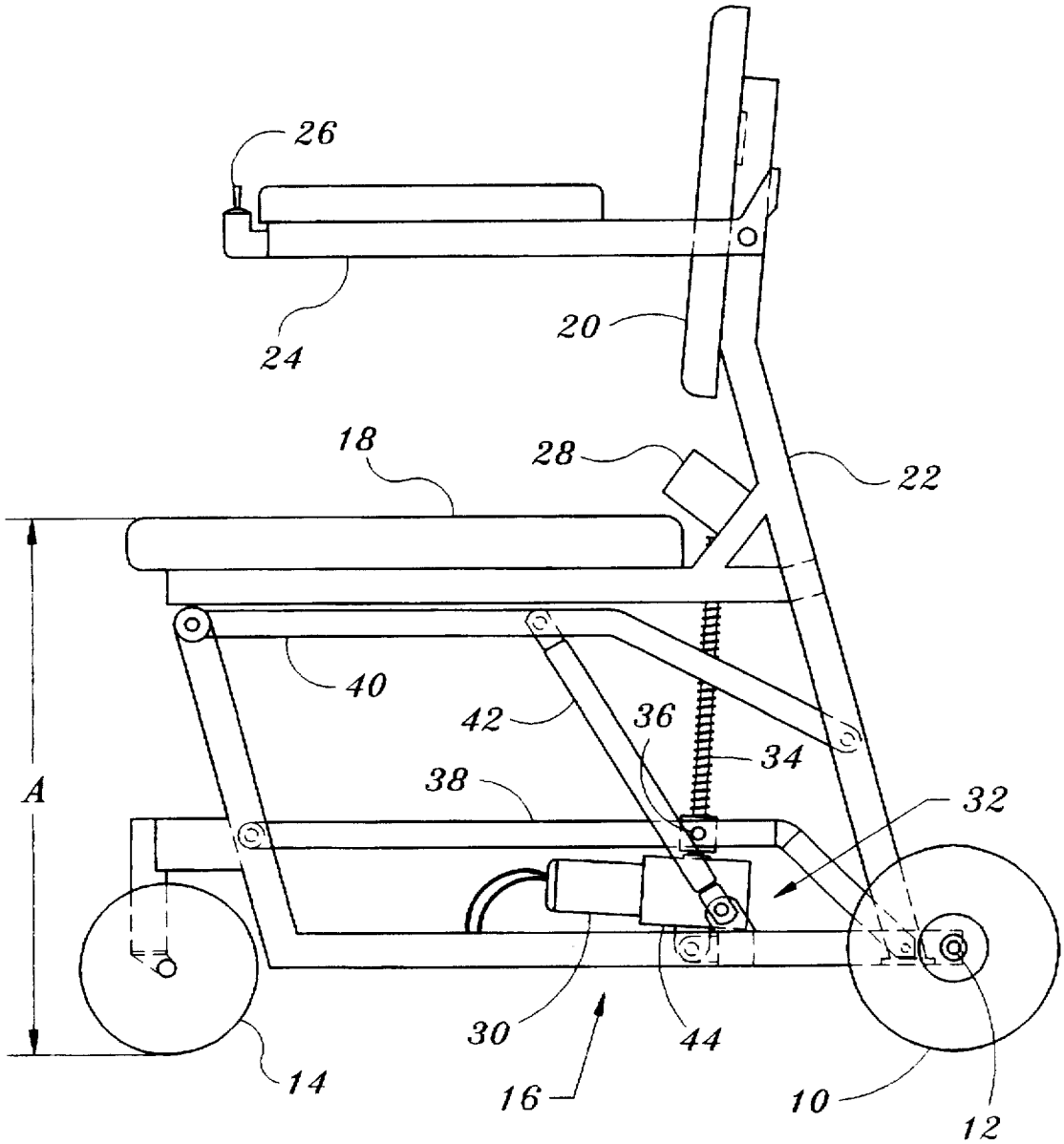
FIG. 1 is a side view of an elevating chair in the lower position and produced in accordance with the preferred embodiment of the present invention.

As an answer to the posed problem, the disclosed invention, as shown in FIG. 1, shows an elevating chair with wheels for lateral translation. Here the wheels are shown to be comprised of a pair of rear wheels 10 which are pivotally mounted to a rear axial 12, and a pair of pivotally mounted casters 14 on the front of the base frame 16. The casters 14 allow increased maneuverability of the chair by enabling the chair to steer from side to side.

The chair also includes a bottom seat 18 and a seat back 20 for the comfort of the user. The seats are fastened to the seat frame 22 which also supports an arm rest 24. Here the arm rest 24 is pivotally mounted to the seat frame 22, thereby allowing the arm rest 24 to be rotated up and out of the way of the user to facilitate transfers into bed or onto another chair. The arm rest 24 is not a necessary component of the invention but it is beneficial to the user in most cases. To provide control of vertical movement to the user a switch 26 has been included and positioned here in the arm rest 24. The switch 26 completes electrical contact between a battery 28 and the motor 30 of an actuation means 32. The battery 28 is shown here to be a rechargeable type and positioned to be easily accessible to the user. The rechargeable capability of the battery 28 and even the existence of the battery 28 and the switch 26 are not necessary to the function of the invention but are preferable. The actuation means 32 could be activated by plugging and unplugging the motor 30 into an alternating current source, but this would limit the versatility and ease of use of the device and is therefore not shown here as pertaining to the preferred embodiment.

The actuation means 32 includes a lead screw 34 and a nut 36. The nut is pivotally attached to a first or lower linkage 38 and also pivotally mounted between the base frame 16 and the seat frame 22. A second or upper linkage 40 is also pivotally mounted to both the base frame 16 and the seat frame 22 at some distance from the lower linkage 38. Here a counter balance 42 is shown in the form of a pneumatic spring, a hydraulic spring or a compression spring that is pivotally attached to the base frame 16 and the upper linkage 40 to offer rotational torque to the linkage 40 to move the seat upward, aiding in counteracting the weight of the user, decreasing the work done by the actuation means 32 to lift the user, thereby increasing the life of the battery 28 between charges. The actuation means could include any or some combination of: a ball screw; an acme thread screw; or a fluid power ram and cylinder such as a pneumatic or hydraulic cylinder. The most efficient of these is a ball screw with an electric motor 30 and gear box 44 to drive the lead screw 34 and that is what is shown here.

The preferred embodiment of the invention is with a rechargeable battery to drive the actuation means to lift the weight of the user as much as 12 vertical inches. To optimally do this the design of the linkages, actuation means and counter balance should each and cooperatively function to give minimal discrepancy between maximal and minimal respective loads throughout the range of motion of the vertical travel of the seat. The amount of work done by any component or the net of the system can be graphically illustrated by the area under the curve of the range of motion of the device on the abscissa (horizontal axis) and with the force along the ordinate (vertical axis). The total work done against a given load is a given value, but the load at any time seen by that component is designated by the vertical displacement along the vertical axis. This peak loading is what would enable the system to function against the load as the power supply began to decrease. Therefore the optimal efficiency of the system would be graphically designated by a line of minimal vertical variance, thus the load is essentially constant throughout the range of motion.

Figure 2:
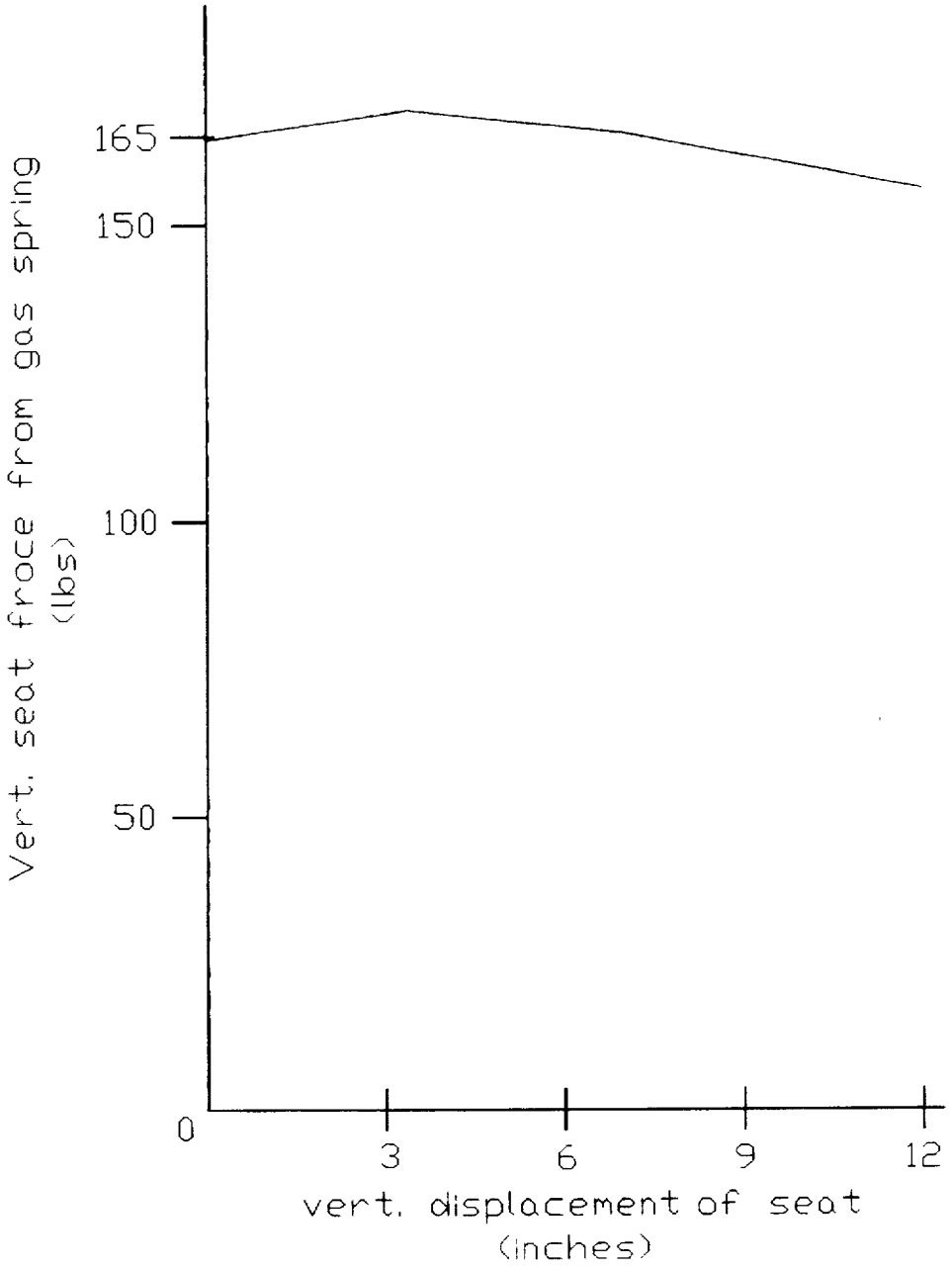
FIG. 2 is a graph showing seat load from the spring counterbalance on an elevated chair a shown in FIG. 1 and produced in accordance with the preferred embodiment of the present invention.
Figure 3:
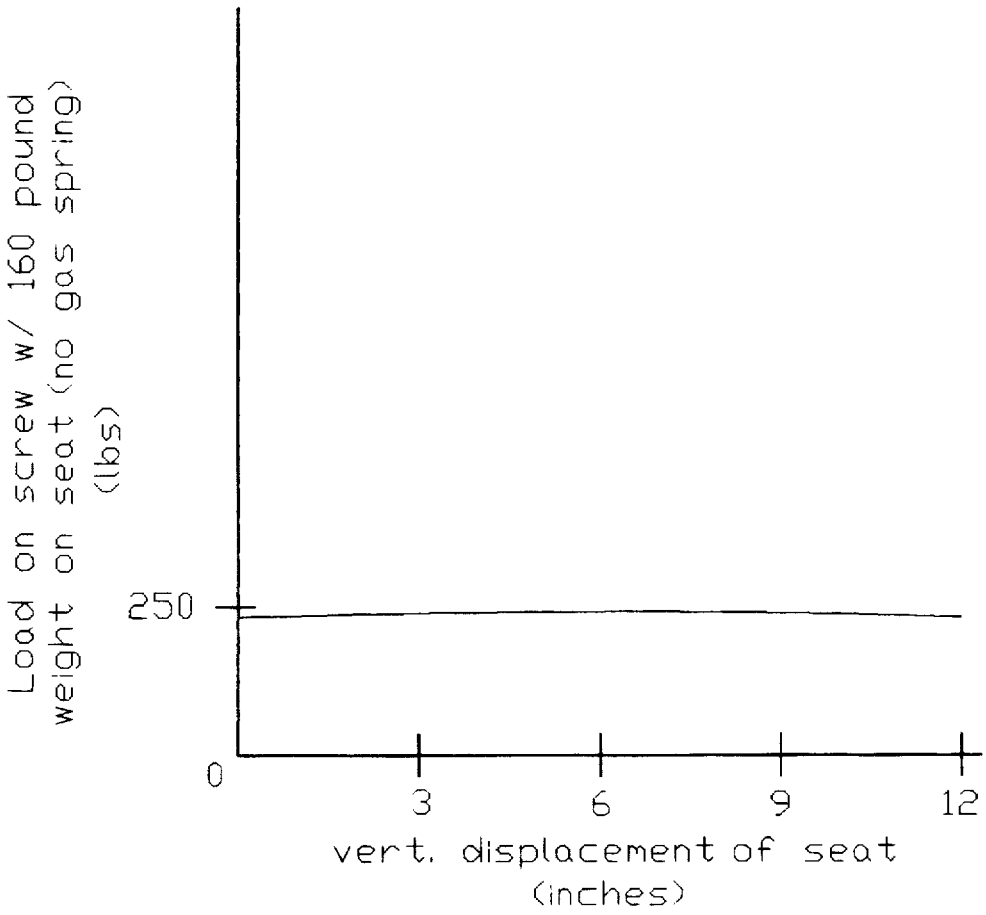
FIGS. 3 is a graph showing load on the screw on an elevated chair as shown in FIG. I and produced in accordance with the preferred embodiment of the present invention.
Figure 4:
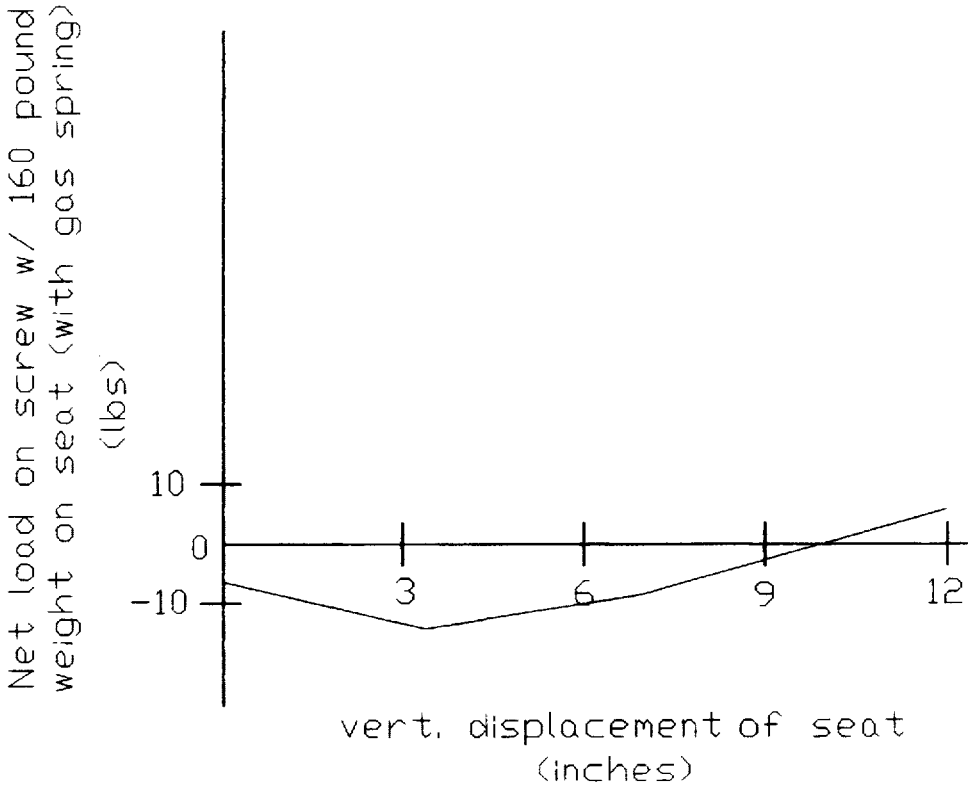
FIG. 4 is a graph showing net load on the screw with the spring counterbalance on an elevated chair as shown in FIG. I and produced in accordance with the preferred embodiment of the present invention.

FIG. 2 graphically depicts the linkage to scale as the invention is shown in FIG. 1. This shows the vertical force pushing up on the seat from a pair of 600 Newton gas (pneumatic) springs with 160 mm stroke length mounted on the upper linkage in the position as shown. FIG. 3 shows the load on the screw (motor) with a 160 pound person seated on the seat and no counter balance spring. Finally, the depiction as displayed in FIG. 4 shows the load on the screw (motor) with the 160 pound load on the seat and the counter balance spring as it would be used. In all cases the curve is substantially flat or at least with minimal vertical peaks. This proves the capability of such a linkage combination to perform as desired to optimize the functionality of the invention in the real world.

Figure 5:
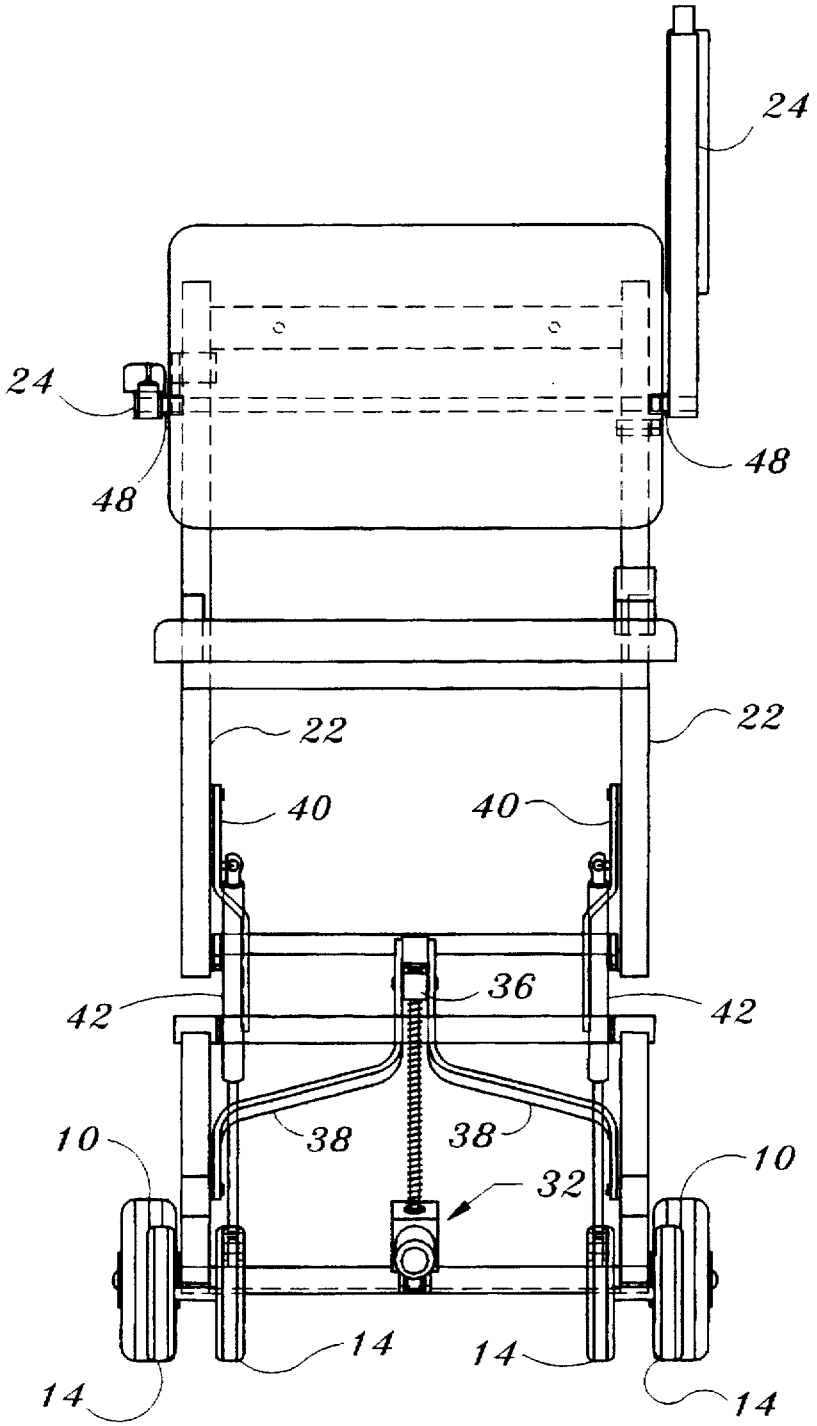
FIG. 5 is a front view of an elevating chair in the elevated position and produced in accordance with the preferred embodiment of the present invention
Figure 6:
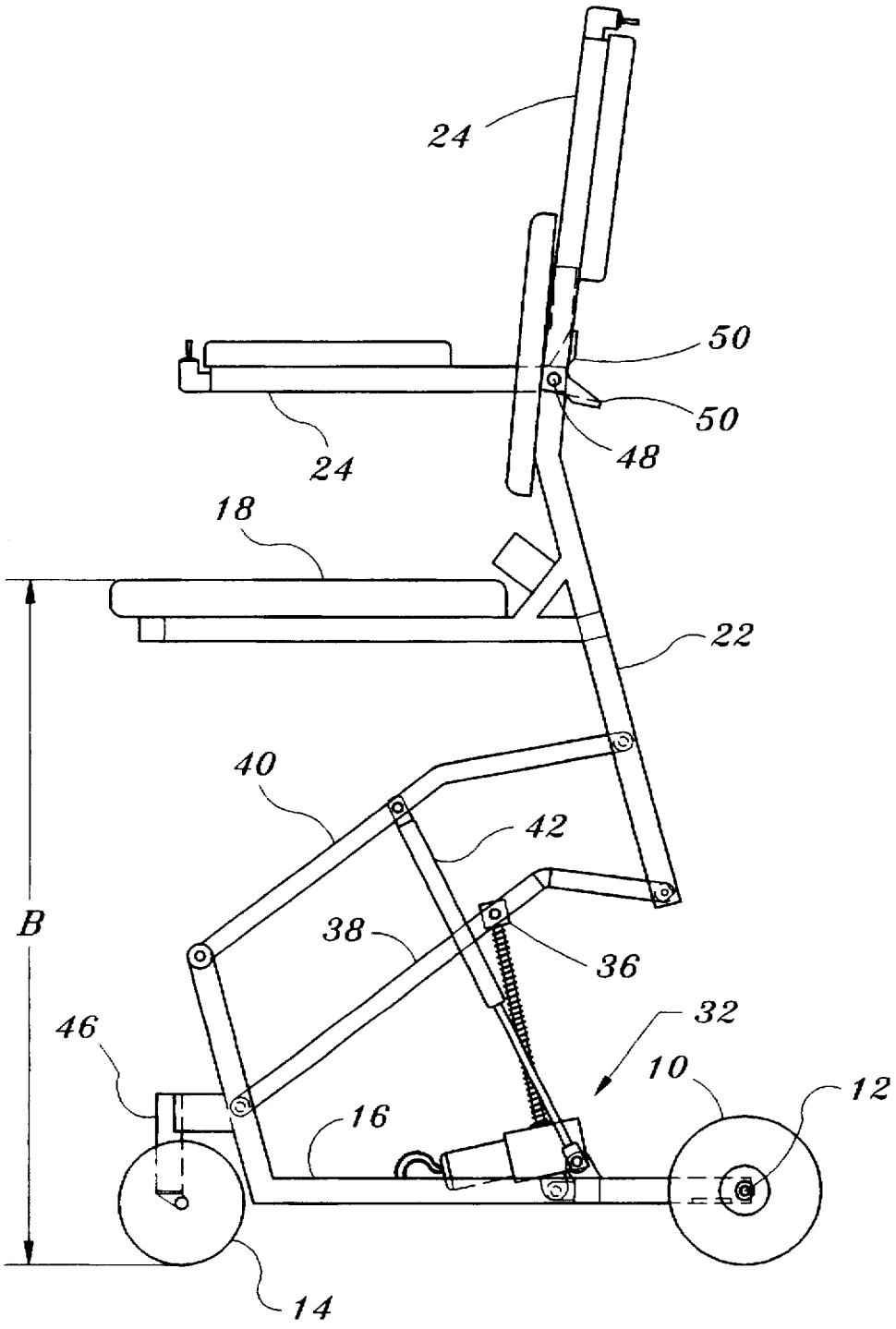
FIG. 6 is a side view of an elevating chair in the elevated position and produced in accordance with the preferred embodiment of the present invention

The device is shown in FIG. 5 and FIG. 6 in the elevated position. Dimension "B" here shows the distance from the floor to the seat top as with dimension "A" in FIG. 1 when the invention is in the bottom position. The scaled distance between these dimensions is 12 inches, allowing for a functional range of vertical movement to the user.

A front view of the invention is shown in FIG. 5 in which the actuation means 32 is shown in a preferred embodiment as being centered on the base frame 16 with the nut 36 pivotally attached to the lower linkage 38. Two counter balance springs 42 are shown connecting the base frame 16 to the upper linkage 40 near the outside edges of the invention. This adds lateral stability to the device, especially while the seat is in the elevated position, as shown here.

The front casters 14 are shown here to have double wheels and to be pivotally mounted to the base frame 16 by the caster support 46. This allows for full 360 degree rotation of the front casters, thus with the lightweight design, the invention provides great maneuverability. The device could include one wheeled casters and casters on the rear of the base frame 16 in place of the rear wheels 10, which are shown here to be pivotally mounted only on the axial 12. The number and size of the wheels are not considered critical to the function of the invention.

The arm rests 24 is shown here to be one in the up, or retracted position, and one down, as would be when the chair is in use. The up position would be desirable for the user in entering or exiting the seat 18 of the invention. The retraction of the arm rest 24 could be made to telescope but is more efficiently shown here to be pivotally attached to the seat frame 22 by the arm pivot mount 48. The arm stop 50 prevents rotation of the arm rest 24 beyond the accepted retracted and in use positions.

The vertical displacement of the invention is depicted in FIG. 6. Here, as shown in the side view, the counter balance spring 42 and the actuation means 32 have been fully extended, thus displacing the upper linkage 40 and the lower linkage 38 respectively, vertically displacing the seat 18 through movement of the seat frame 22. The arm rests 24 are also shown with one being in the up and one in the down positions and are done so for illustration purposes.

Figure 7:
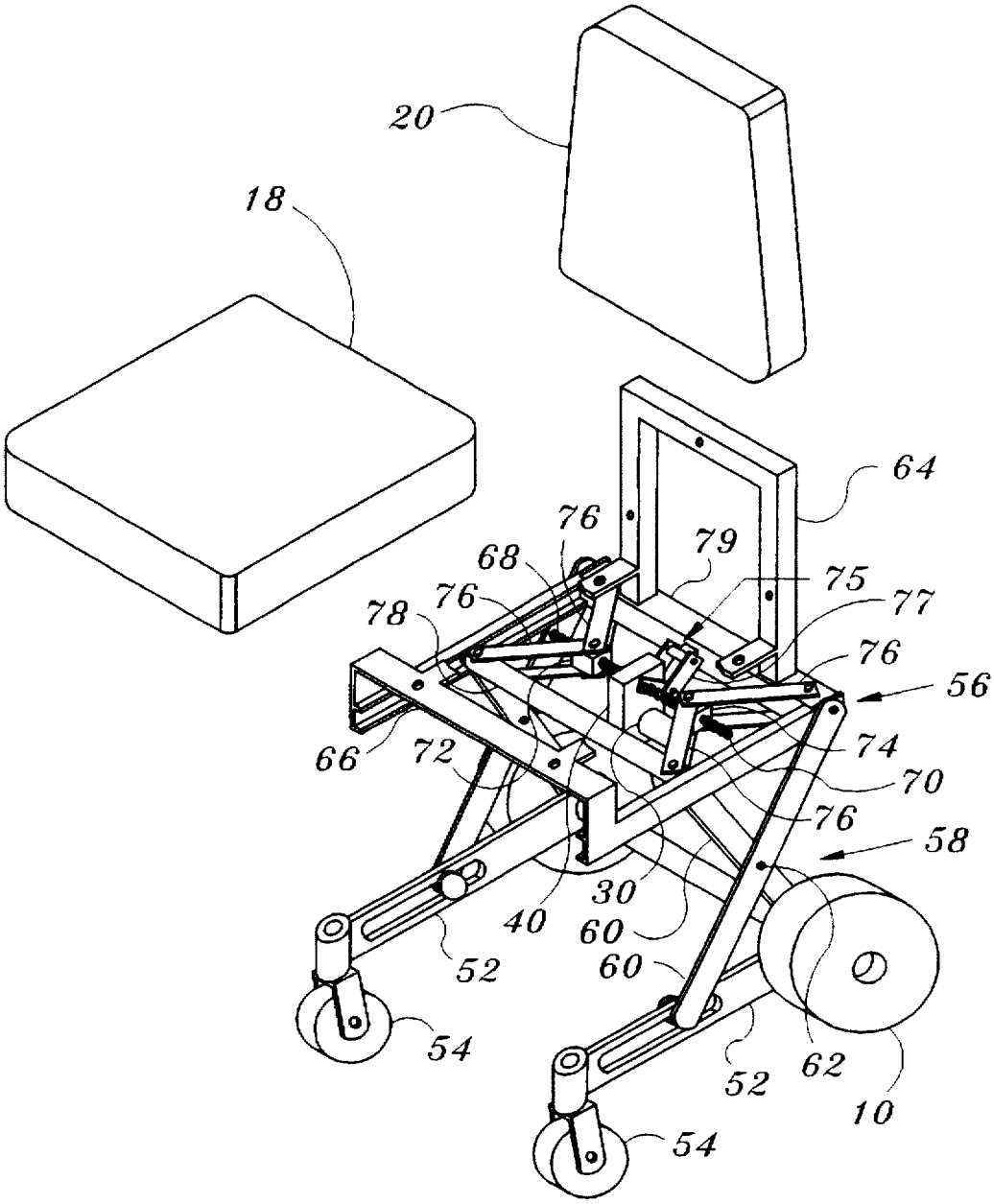
FIG. 7 is an isometric view of an elevating chair, shown in the elevated position and produced in accordance with an alternative preferred embodiment of the present invention.

An alternative to the preferred embodiment is shown in FIG. 7 wherein a lower frame 52 is affixed with a set of single wheel casters 54 on the front and a set of rear wheels 10 on the back in a manner similar to the earlier disclosed. An upper frame 56 is connected to the lower frame 52 by use of at least one scissors linkage 58. Here only one linkage set is shown, but it understood that two or more of these linkages could be mounted one on top of the other thereby increasing the vertical movement function of the invention. The scissors linkage 58 is comprised of at least one pair of bars 60 which are pivotally attached in the center by a pin 62. As shown here, the back end of each bar 60 is pivotally attached to the respective frame, one to the upper frame 56 and one to the lower frame 52. The front of each bar 60 is slidably attached to the front end of the other frame. The front and rear of the device or even reversing one frame with respect to the other does not take away from the function of the disclosed invention.

The upper frame 56 is further comprised of a back support 64 and a seat support 66 or the seat back 20 and the bottom seat 18 to be respectively fastened thereto. Here, the combination of the motor 30 and gearbox 44 is mounted between the upper ends of the bars 60 and are connected by a right lead screw 68 and a left lead screw 70. The right lead screw 68 has right hand threads and the left lead screw 70 has left hand threads which are respectively received by the appropriately threaded right nut 72 and the left nut 74. Both nuts are pivotally attached to one end of a pair of longitudinal links 76 with the other end pivotally attached to a cross bar 78. The front cross bar 78 is attached to the ends of the bars 60 thereby providing lateral movement of the front cross bar 78 to the rear cross bar 79 as both the right nut 72 and left nut 74 are driven toward the gear box 40 by rotation of the right lead screw 68 and the left lead screw 70. As the front cross bar 78 and the rear cross bar 79 are pulled together, the scissors linkage 58 is extended, thereby further displacing the upper frame 56 from the lower frame 52 and raising the user seated thereon. A gear box locator 75 is used to prevent lateral side movement of the gear box 40 while providing necessary forward and aft movement of same to ensure proper alignment. Here the locator 75 is shown to be a set of pivotally mounted links 77 mounted to the gear box 40 and the rear cross bar 79. To lower the seat the rotation is reversed. The presence of the power supply and switching mechanism is in accordance with the previously disclosed.

As with the previously disclosed linkage, the load requirement on the motor is well balanced throughout the range of motion of the device, thus eliminating potential stalling of the motor. As the angle between the longitudinal links 76 one side decreases, the force vector representing load on the respective nut 72 or 74 would increase, but as this happens the front cross bar 78 and the rear cross bar 79 are drawn closer together, decreasing the moment about the pin 62 which translates into vertical movement of the upper seat 56. Conversely, as the seat lowers the moment increases about the pin 62, the cross bars 78 and 79 move further apart one from the other, decreasing the load vector in the nut. This balanced load is integral to the life and function of the invention.

Figure 8:
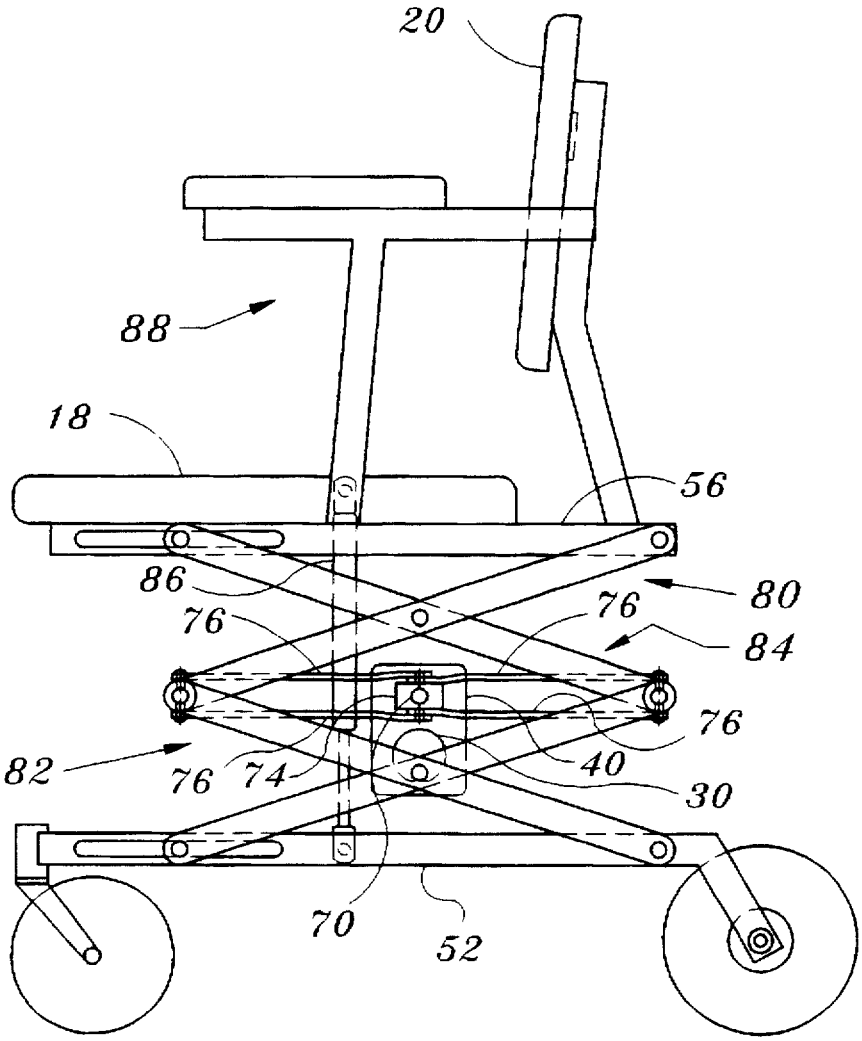
FIG. 8 is a side view of an elevating chair, shown in the mid-elevated position and produced in accordance with an alternative preferred embodiment of the present invention.

A double scissors linkage is shown in FIG. 8. Here the lower frame 52 is connected to the upper frame 56 by top scissors linkage 80 stacked on a bottom scissors linkage 82. The top scissors linkage 80 is connected to the bottom scissors linkage 82 by a horizontal actuation means 84 which is similar to that disclosed in FIG. 5. Here the motor 30 and gearbox 40 function with the right and left lead screws 68, 70 and their respective nuts 72, 74 to actuate the longitudinal links 76, but here the cross bars connect one scissors linkage to the other, which in turn connects the lower frame 52 to the upper frame 56, instead of directly as previously disclosed. The advantage to the double scissors is double the vertical movement of a single scissors, within a small package. Here is also shown a spring 86 that would be used as a counter balance to the weight of the user. As with the previously disclosed version of the preferred embodiment, the single scissors could also incorporate such a device in a manner similar to that shown here.

An alternative arm rest 88 is also shown here being fixed tot he upper frame 56 and not retractable, as previously shown. Though patient transfer would be more difficult with this embodiment, the related costs of production would be reduced and the structural stability would be greater. Variations in these and other components of the invention are considered to be obvious and thereby included within the scope of this invention.

What is claimed is:

1. An elevating chair comprising a base frame with at least one wheel attached thereto, providing movement thereof;

a seat suitable for receiving a user thereon and a seat frame supporting the seat;

a pair of scissors linkages, each linkage comprised of two longitudinal bars being pivotally attached one to another, between the end portions of same, one end of one longitudinal bar being pivotally attached to said seat frame and another end slidably attached to said base frame, and the other longitudinal bar having one end being slidably attached to said seat frame and the other end pivotally attached to said base frame;

at least two cross bars connecting two of said end portions of said longitudinal bars of one scissors linkage to two of said end portions of said longitudinal bars of the other scissors linkage;

an actuation means including a controller which is accessible to the user, and a drive means to impel the actuation means, at least one lead screw in a substantially horizontal orientation and mechanically attached to said drive means, thereby being capable of rotating the lead screw and at least one nut capable of articulating with the lead screw; and at least two cross linkages, each cross linkage comprised of at least two longitudinal links, each with one end pivotally attached to one end of one of said at least two cross bars, and the other end pivotally attached to said nut, whereby a user of limited physical potential, positioned on said seat, can locomote while seated and drive said actuation means, by use of a controller, thereby displacing said nut from said drive means causing movement of said cross linkage thereby altering the displacement between said at least two cross bars, moving said pair of scissors linkages, altering the displacement of said seat frame to said base frame, thereby altering the user's seated height to assist in performing daily tasks and do so with minimal load on the drive means.

2. The elevating chair as described in claim 1, further comprising a spring counter balance fastened to said base frame and said seat frame, further enabling movement of said linkage means to displace said seat frame from said base frame, thereby overcoming some portion of a load placed on said seat.

3. The elevating chair as described in claim 2, wherein said spring counter balance is comprised of at least one spring selected from the group consisting of a pneumatic spring, a hydraulic spring and a compression spring.

4. The elevating chair as described in claim 1, further comprising a potential energy storage device secured to the elevating chair and providing energy communication with said drive means, whereby said drive means is capable of being powered by the potential energy storage device while enabling complete mobility of the elevating chair.

5. The elevating chair as described in claim 4, wherein said electrical energy storage device includes a battery and said drive means includes an electric motor.

6. The elevating chair as described in claim 1, wherein said lead screw is a screw selected from the group consisting of a ball screw with a ball nut and a general purpose acme thread screw with an acme thread nut.

* * * * *